US007470078B2

(12) United States Patent
Banco et al.

(10) Patent No.: US 7,470,078 B2
(45) Date of Patent: Dec. 30, 2008

(54) CLEANING IMPLEMENT

(75) Inventors: Michael J. Banco, Racine, WI (US); Peter M. Neumann, Racine, WI (US); Kenneth W. Michaels, Spring Grove, IL (US); Kevin Harrity, Oak Creek, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 344 days.

(21) Appl. No.: 11/354,384

(22) Filed: Feb. 15, 2006

(65) Prior Publication Data

US 2006/0188320 A1 Aug. 24, 2006

Related U.S. Application Data

(60) Provisional application No. 60/654,348, filed on Feb. 18, 2005.

(51) Int. Cl.
*A47L 13/26* (2006.01)
*A47L 13/12* (2006.01)

(52) U.S. Cl. ..... 401/139; 401/25; 401/27

(58) Field of Classification Search ..... 401/139, 401/188 R, 25, 27, 137, 16
See application file for complete search history.

(56) References Cited

U.S. PATENT DOCUMENTS

| | | | | |
|---|---|---|---|---|
| 1,500,274 | A | 7/1924 | Scarling | |
| 1,828,715 | A | 10/1931 | Oishei | |
| 2,587,382 | A | 2/1952 | Pyne | |
| 2,832,086 | A | 4/1958 | Wells | |
| 2,859,463 | A | 11/1958 | Hirsch | |
| 2,889,699 | A | 6/1959 | Ames | |
| 3,103,033 | A | 9/1963 | Ames | |
| 3,724,017 | A * | 4/1973 | Mallory | 15/121 |
| 3,909,870 | A * | 10/1975 | Leland | 15/121 |
| 4,725,489 | A | 2/1988 | Jones et al. | |
| D294,989 | S | 3/1988 | Jinkins | |
| 4,776,716 | A * | 10/1988 | Huang | 401/139 |
| D316,318 | S * | 4/1991 | Cheang | D32/42 |
| 5,054,945 | A * | 10/1991 | Iggulden et al. | 401/23 |
| 5,364,198 | A | 11/1994 | Skenderi | |
| 5,497,530 | A * | 3/1996 | Kamm et al. | 15/321 |
| 5,865,551 | A * | 2/1999 | Lalli et al. | 401/139 |
| 5,970,560 | A | 10/1999 | Leroux | |
| 6,010,267 | A | 1/2000 | Vito | |
| 6,082,915 | A | 7/2000 | Kimmel | |
| 6,092,255 | A | 7/2000 | Kim | |
| 6,223,380 | B1 | 5/2001 | Klima et al. | |
| 6,250,831 | B1 * | 6/2001 | Craven | 401/139 |
| 6,305,042 | B1 | 10/2001 | Lalli | |
| 6,378,739 | B1 | 4/2002 | Maas et al. | |
| 6,412,997 | B2 | 7/2002 | Berke et al. | |

(Continued)

*Primary Examiner*—David J Walczak

(57) ABSTRACT

A cleaning implement that provides multiple functions useful in cleaning windows and similar surfaces is disclosed. There is a support head mounting a squeegee blade and (optionally) a scrubber and/or touch-up pad. There is also a collector absorbent pad that is mounted to the support head adjacent the squeegee blade, a sprayer linked to the support head, and a container connectable to the sprayer. The implement can spray cleaning fluid on a window to be cleaned. The scrubber can then be applied, followed by the squeegee. Liquid being removed from the window using the squeegee is then collected in the absorbent pad, which is replaceable when saturated. Any remaining streaks on the surface being cleaned can then be removed by the touch-up pad. Replacement pads and replacement containers are also disclosed.

12 Claims, 6 Drawing Sheets

U.S. PATENT DOCUMENTS

| | | | | |
|---|---|---|---|---|
| 6,547,469 | B2 | 4/2003 | Vito | |
| 6,668,418 | B2 | 12/2003 | Bastien | |
| 6,692,171 | B2 | 2/2004 | Vito | |
| 6,702,497 | B1 | 3/2004 | Tien | |
| 6,742,951 | B2 | 6/2004 | Schultz et al. | |
| 2003/0135181 | A1 * | 7/2003 | Chen et al. | 604/374 |
| 2003/0180083 | A1 | 9/2003 | Hall et al. | |
| 2004/0141798 | A1 | 7/2004 | Garabedian, Jr. et al. | |
| 2006/0171767 | A1 * | 8/2006 | Hoadley et al. | 401/136 |

* cited by examiner

FIG. 2
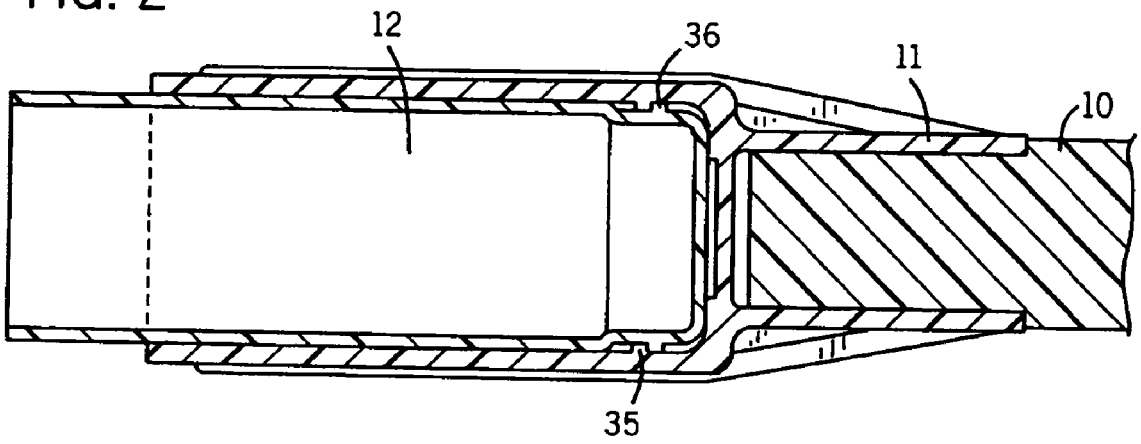
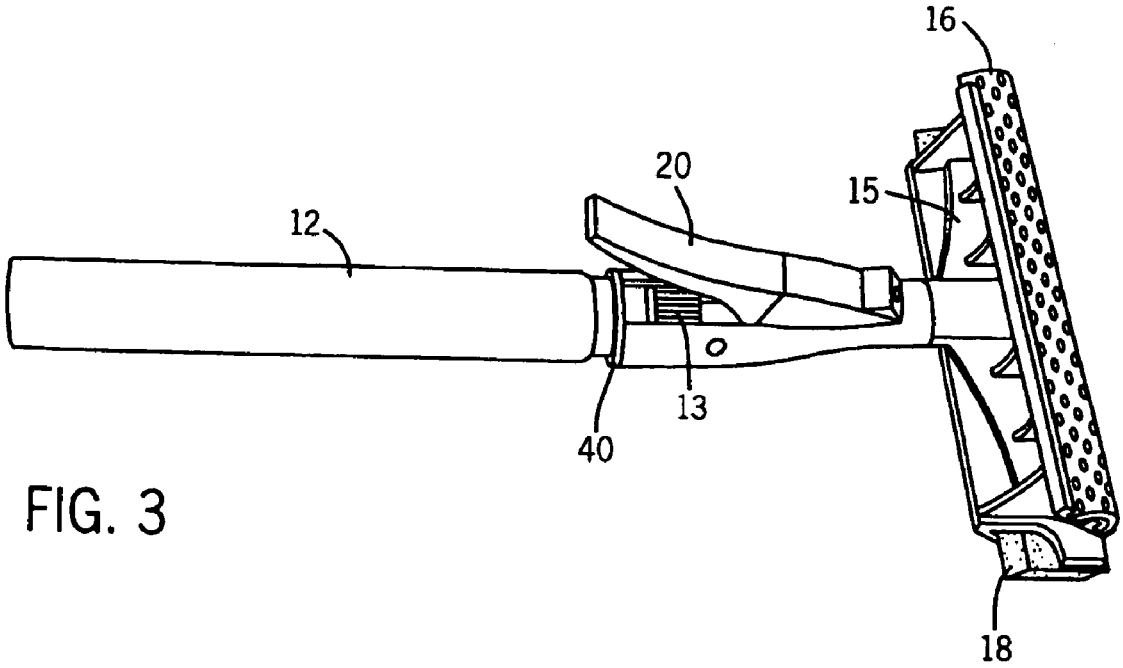
FIG. 3

FIG. 5
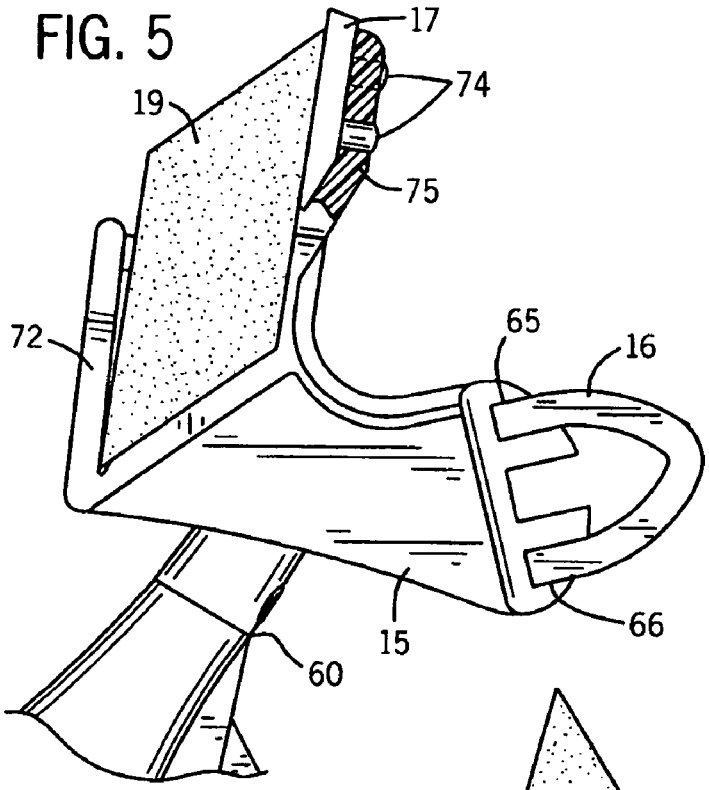
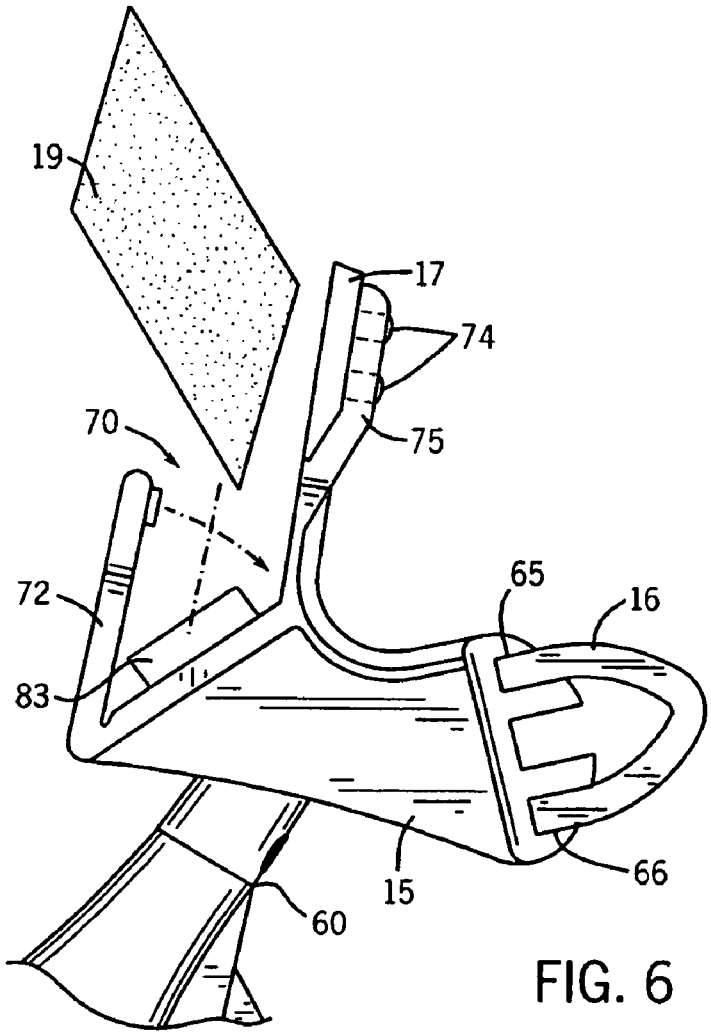
FIG. 6

CLEANING IMPLEMENT

CROSS-REFERENCE TO RELATED APPLICATIONS

This application claims priority based on U.S. Provisional Application 60/654,348 which was filed on Feb. 18, 2005.

STATEMENT REGARDING FEDERALLY SPONSORED RESEARCH/DEVELOPMENT

Not applicable.

BACKGROUND OF THE INVENTION

The present invention relates to devices for cleaning windows and other hard surfaces. More particularly, it relates to devices that can deliver cleaning fluid to the surface to be cleaned, have a pad (e.g. scrubbing or touch-up) for facilitating removal of solids and stains, have a squeegee blade for scraping off used cleaning liquid, and also have a collector to collect that used liquid.

Cleaning of glass windows and other similar hard surfaces is typically a multi-tool and multi-step process. One sprays or otherwise applies a cleaning fluid to the surface to be cleaned, rubs the cleaning fluid against encrusted or other hard to remove materials on the surface, and removes the liquid. The liquid can be removed by rubbing a dry paper towel or rag over the surface. However, this can leave streaks and/or lint on the surface being cleaned. Further, this leaves wet and soiled paper or rags to be dealt with or disposed of.

Alternatively, the used cleaning fluid can be scraped off the surface using a squeegee. This technique is often used when cleaning the outsides of building windows where "drool" from the squeegee can drip off the window onto a building side or the ground without significant adverse effects. However, using a conventional squeegee indoors is messy. Further, squeegees can sometimes leave small streaks of remaining liquid.

There have been attempts to collect liquid as it is being squeegeed off windows or other surfaces, using wicking or absorbent layers adjacent the squeegee blade. See e.g. U.S. Pat. Nos. 5,970,560, 6,092,255 and 6,668,418. However, the assemblies for collecting the waste liquid in these structures were not optimized. Thus, these systems quickly saturated, and/or were difficult to adjust to re-establish optimal collection conditions.

In any event, to clean a window or the like, one will typically have to pick up a spray bottle, spray a cleaning liquid against the window or other surface, put the bottle down, pick up and use a sponge or other scrubber against the window, put the sponge down, and then pick up and use the squeegee. This can be followed by using a drying cloth or towel to clean up or touch-up missed areas. This is time consuming and require the person doing the cleaning to expend more energy than is optimal.

There have therefore been some attempts to link a sprayer and/or scrubber to a squeegee. See e.g. U.S. Pat. Nos. 2,587,382, 2,832,086, D294,989, D316,318, 5,364,198, 6,010,267, 6,223,380, 6,547,469, 6,692,171 and 6,702,497. There are also a number of squeegee devices that are mounted on extension poles so that the device can be used to clean windows that are beyond the normal reach of a consumer, without using a ladder. See e.g. U.S. Pat. Nos. 1,500,274, 6,010,267 and 6,092,255.

Nevertheless there is a continuing need for improved cleaning implements, particularly those that minimize the number of tools involved in the cleaning process.

BRIEF SUMMARY OF THE INVENTION

In a first embodiment the invention provides a cleaning implement having a support head mounting a squeegee blade (and optionally a scrubber and/or touch-up pad). There is also a collector removably mounted to the support head adjacent the squeegee blade, a sprayer linked to the support head, and a container mountable to the cleaning implement so as to place an internal cavity of the container in communication with the sprayer, the container being suitable to contain a cleaning liquid in the internal cavity.

The collector is designed to collect used cleaning liquid that is being squeegeed off of a window or the like. The squeegee blade scrapes the cleaning liquid off the window, and the scrubber (when present) helps remove encrusted or other hard to remove stains. The container holds a supply of cleaning fluid, and the sprayer draws that fluid from the container and delivers it adjacent the scrubber. Most preferably, the collector is in the form of a pad mounted in a mouth of the support head. When the touch-up pad is present, it can dry off any streaks left by the squeegee.

In preferred forms the scrubber can be made from an apertured silicone rubber sheet that has been bent into a U shape and removably mounted to the support head. A variety of other scrubbers (e.g. conventional sponges) may also be permanently or removably mounted to the support head. Also, the touch-up pad can preferably be made of microfiber material.

The support head may be formed with an open flexible mouth that is biased towards the closed position, albeit not to a completely closed position. The squeegee blade is mounted to an upper lip of the mouth. It may be adhered to the lip with an adhesive, and/or a projection from an upper side of the blade may be jammed into or through the lip. A variety of other means for mounting the squeegee are also possible, such as bolts.

The collector is removably mounted in the mouth, preferably directly under the squeegee blade. The mouth flexibly bites against the collector to retain it by frictional force. In addition, the collector can be provided with one or more rear slots, and the rear of the mouth can be provided with forwardly projecting tongues. The tongues and slots interfit to help align the collector in the mouth.

The function of the collector is to quickly collect soiled liquid that is being scraped off the window by the squeegee blade. It is therefore preferred that the collector be made of a material that has a high capacity for retaining moisture, and an exceptional capacity to quickly pick up moisture so that the liquid does not have a chance to drool before it is collected. Moreover, it is preferred that the collector have sufficient integrity such that if it is dragged against a window while the squeegee is operating (to assist the drying process) it will maintain its structural integrity rather than breaking into grit or other fragments.

The collector can be made of an absorbent such as a porous plastic. Particularly preferred absorbents are porous polyethylene materials available from Porex. Alternatively, one could provide a cellulosic pad with horizontal capillary fibers made of plastic to improve integrity and water transport.

The collector should preferably absorb and retain at least 50 gm. of water. This helps insure that the consumer does not have to change the pad frequently. Further, a superabsorbent can be placed at the rear of and adjacent to the collector so that the collector will wick the liquid to the superabsorbent. This makes the superabsorbent the primary replaceable element, extending the life of the collector slab.

In another aspect the invention provides a collector for the above purpose. The collector is a slab of absorbent material of the above type having a recess at a rear end thereof. The recess is suitable to receive a tongue extending from the rear of the mouth of the support head.

The container preferably holds an aqueous surfactant-based cleaning solution such as Windex® brand window cleaner, available from S.C. Johnson & Son, Inc. Alternatively, the liquid need not be water-based, and may have other functions besides cleaning (e.g. polishing, antibacterial treatment, insect treatment, etc.). Thus, the nature of the liquid in the container is not critical to the invention.

The container is preferably removably threaded into a lower end of the sprayer. This permits the container to be replaced by another filled container when the first container has been emptied.

The container can have an upper neck onto which is positioned a radially outwardly extending flange, above which is positioned radially outwardly extending threads. The sprayer has a lower skirt which rests on and is supported by the flange. Most preferably the distance between a top of the flange and a top of the threads is at least two centimeters.

The interaction between the skirt and the flange permits the forces encountered by the squeegee and scrubber to be dissipated around the entire flange, thereby reducing the risk of breakage at a weakened point, or the tendency of the support head to bend in response to force on the scrubber or squeegee. This also helps facilitate the use of extension poles. In this regard, the container can be supported by an extension pole (directly or through an adaptor) at an end of the container opposite the sprayer. The additional leverage forces of the longer pole can be accommodated along the flange.

In yet another form the invention provides replacement containers for use with the above implements. The container has an upper neck having both a radially extending flange and radially extending threads positioned above the flange, wherein the flange extends radially outward from the threads.

While a variety of pumps can be used for obtaining the cleaning liquid from the container and spraying it, it is preferred that there be a sprayer which is a trigger operated sprayer. Upon pumping the trigger, liquid will be pumped from the container and then the pump will spray cleaning liquid in a direction adjacent an end of the support head.

The sprayer can be in a housing which is separately formed from the support head. The support head can then be snap connected to the housing. This has the advantage of allowing the product to be shipped in a compact package. Alternatively, the support head can have at its lower end an integral housing for the sprayer.

One possible type of sprayer is a pre-compression type trigger sprayer. This type of sprayer prevents leakage when the cleaning implement is placed on its side. Such a sprayer can be incorporated into the present invention. For example, the pumping system of U.S. Pat. No. 6,378,739 can be incorporated, albeit with the outlet from the pump preferably directed in a more upwardly angled manner, rather than just horizontally.

The container may also have a duck bill type valve adjacent an upper opening of the container through which a dip stick from the sprayer extends. The duck bill valve helps reduce the risk of leakage around the dip stick if the sprayer is not held vertically.

A variety of advantages are achieved by various embodiments of the present invention. The functions of providing and spraying cleaning liquid, scrubbing difficult stains, squeegeeing, collecting used cleaning liquid, and touching-up missed spots, are all achieved by a single compact tool, which can be inexpensively manufactured. The collection function is optimized through use of a replaceable and disposable part.

The design is suitable to be used with an extension pole to permit use on high surfaces (e.g. a second floor window exterior surface). Further, the design reduces the risk of leaks and also provides an assembly which can be compactly shipped and displayed for sale.

The foregoing and other advantages of the invention will become apparent from the following description. In the following description reference is made to the accompanying drawings which form a part thereof, and in which there is shown by way of illustration preferred embodiments of the invention. Such embodiments do not represent the full scope of the invention. Reference should therefore be made to the claims herein for interpreting the scope of the invention.

BRIEF DESCRIPTION OF THE DRAWINGS

FIG. 2 is a vertical sectional view of the portion highlighted in FIG. 1;

FIG. 3 is a frontal perspective view of a portion of the FIG. 1 design (with extension pole and adaptor removed);

FIG. 5 is an enlarged side view of a portion of the cleaning implement of FIG. 4A;

FIG. 6 is a view similar to FIG. 5 but with a replaceable absorbent pad shown in the process of being removed;

DETAILED DESCRIPTION OF THE PREFERRED EMBODIMENTS

Figure 1:
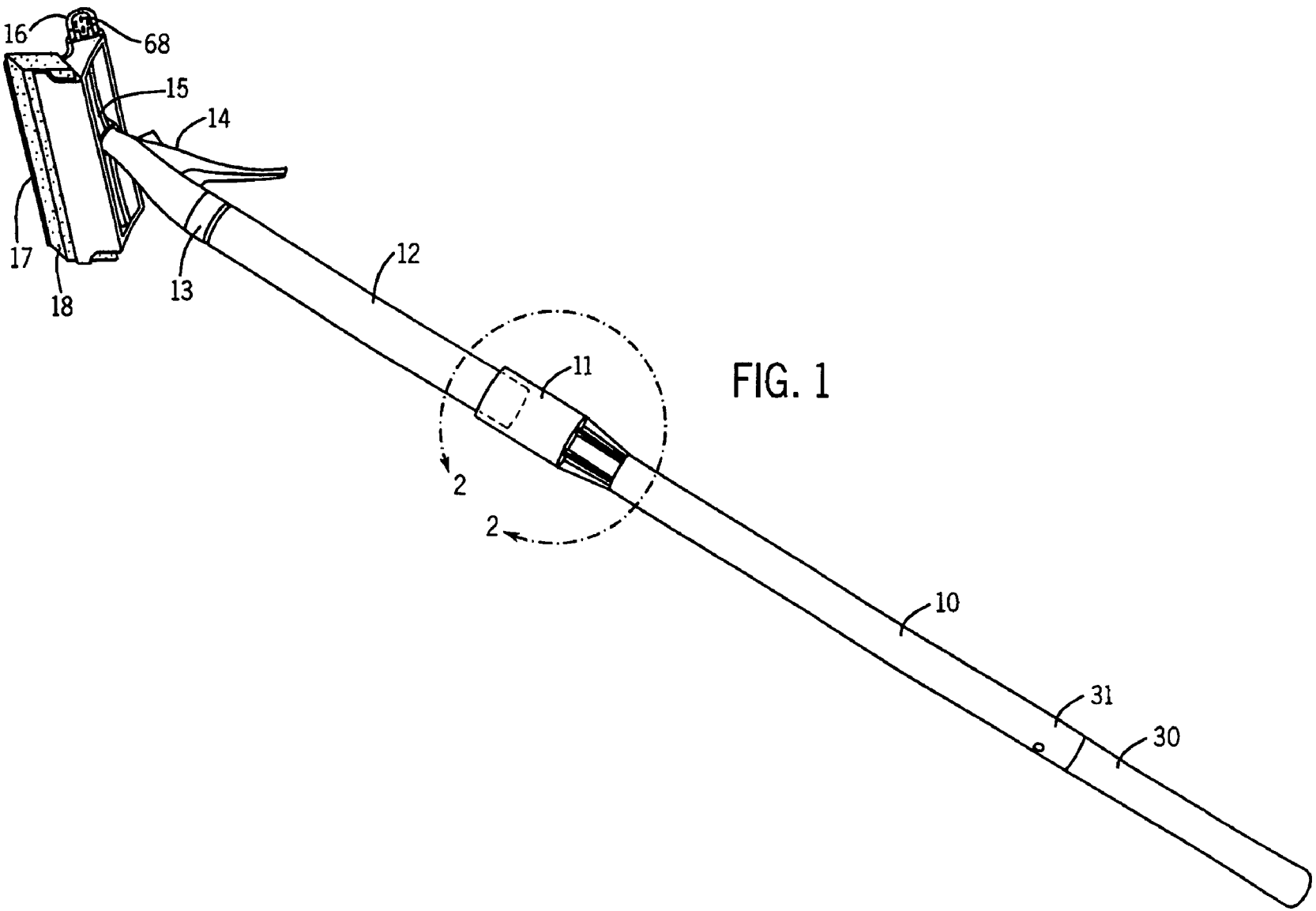
FIG. 1 is a rear perspective view of a cleaning implement of the present invention.

As seen in FIG. 1, the cleaning implement of the present invention may have an extension pole 10, an adaptor 11, a replaceable container 12 containing a cleaning fluid, a cap 13, a pumping assembly (generally 14), a support head 15, a scrubber 16, a squeegee blade 17, and a replaceable absorbent pad 18 constituting a collector 19. When trigger 20 is compressed to position 21 (compare FIGS. 4A and 4B), liquid in a pump 22 of the pumping apparatus 14 is delivered out a nozzle 23 to spray the cleaner on a window or the like. Releasing the trigger creates a suction that draws liquid from the container 12 to reload the pump 22. Thus, the device serves the function of wetting the window with cleaning fluid.

The scrubber 16 can then be pushed against a window to help remove encrusted or otherwise difficult to remove stains. The device can then be rotated 180 degrees on its longitudinal axis so that the squeegee blade 17 and absorbent pad 18 then face the window. The squeegee blade 17 can be dragged down the window so that the liquid on the window falls against the pad. The pad then will absorb the liquid, rather than allowing the liquid to drool onto an adjoining sill or other structure. Hence, the device also serves the function of providing a scrubber, a squeegee, and a collector.

Turning now to a more detailed review of the parts, there is shown in FIG. 1 an extension pole 10, which may be formed in multiple segments 30, 31 that are linked together, or which may be a single piece. Where multiple pieces are used they may telescope into each other if desired.

Preferably, the top of the segment 31 is formed with threads (see FIG. 2) which thread into the bottom of adaptor 11. The interior of the adaptor 11 is formed with radially spaced projections 35 which permit the tabs 36 to go downwardly past the projections 35 at a particular radial orientation. Relative rotation of the container with respect to the adaptor then catches the tabs 36 under projections 35 (in a bayonet connection fashion). Alternatively, the bottom of the container could be threaded with receiving threads in the interior of the adaptor.

In yet another option the adaptor could be dispensed with, with the extension poles threads threading into the bottom of threads formed on the container. However, this would increase the cost of replacement containers.

The container 12 is preferably somewhat elongated so as to also serve as a handle for the cleaning implement, especially when the pole 10 is not present. It has an internal cavity which can receive a liquid to be sprayed. The liquid may range from just rinse water, to a surfactant based mixture constituting a cleaning fluid, to other liquids.

Figure 4A:
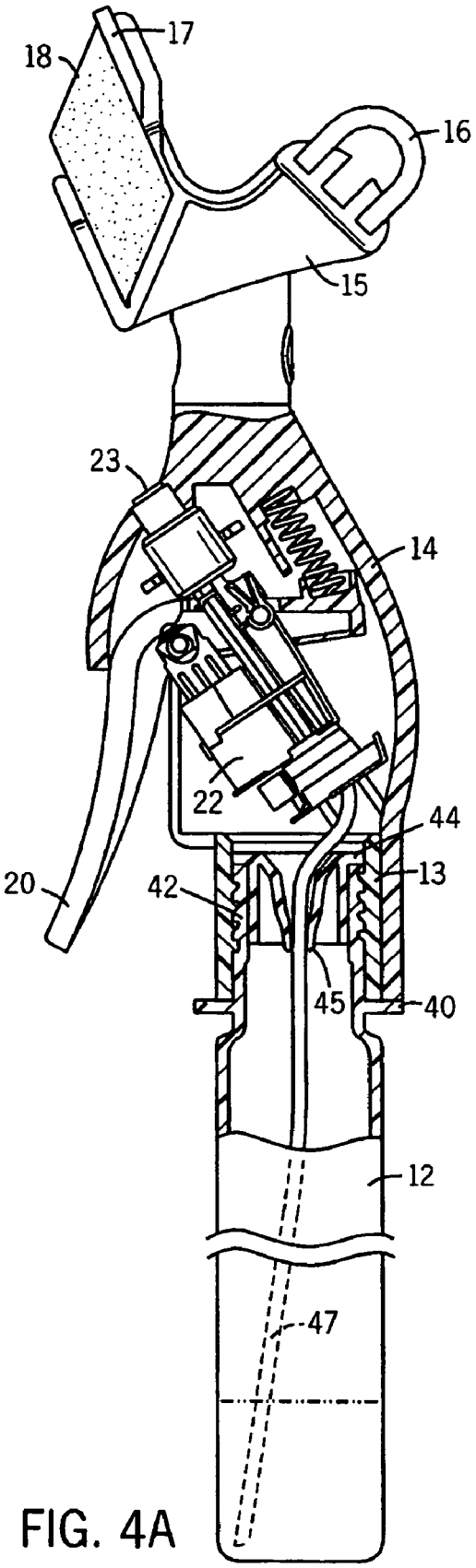
FIG. 4A is a left elevational view of a portion of the FIG. 1 cleaning implement, with a part shown in section to reveal the internal pumping apparatus.
Figure 4B:
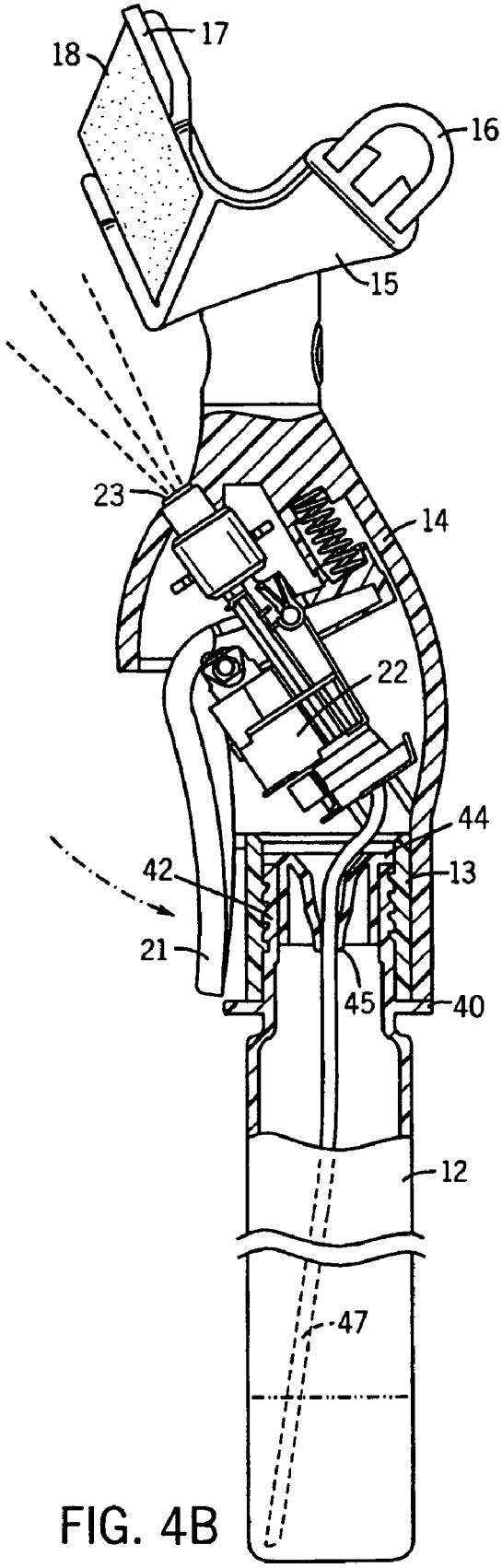
FIG. 4B is a view similar to FIG. 4A, but with a trigger depressed.
Figure 8:
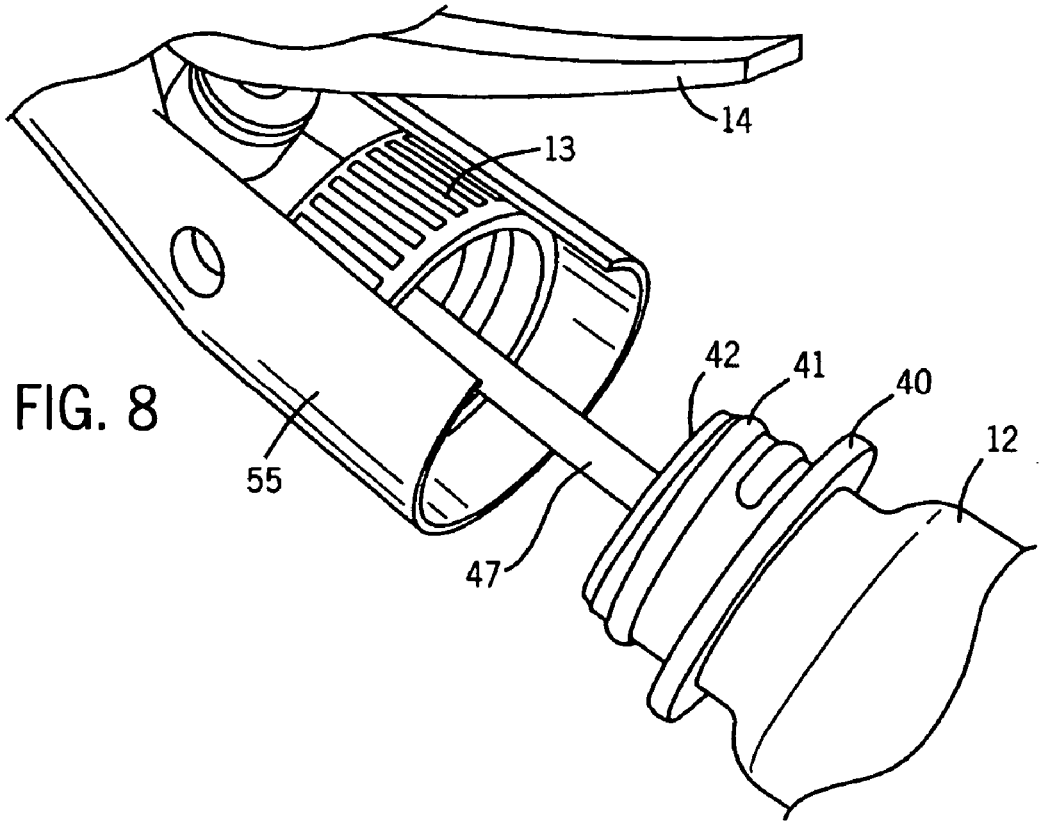
FIG. 8 is an exploded view of a portion of the FIG. 1 design.

As best seen in FIGS. 4B and 8, the top of the container is formed with a flange 40, a peripherally extending thread 41, and an upper opening 42. Gasket 44 having a duckbill entry 45 may be inserted into the opening 42, and a dip tube 47 may extend downward from the pump 22 into the container.

Screw cap 13 is formed on the bottom of the sprayer, the sprayer having internal threads compatible with threads 41 to tightly, yet removably, link the cap (and thus sprayer) to the container. Hence, when a bottle of cleaning fluid is emptied it can be replaced.

The bottom of the sprayer is in the form of a shroud or skirt 55 whose lower edge 56 is preferably extended downward to rest on the flange 40 when the parts are fully assembled. This helps reduce stresses on other portions of the sprayer unit as the cleaning implement is moved along a window.

As will be appreciated from a comparison of FIGS. 4A and 4B, when the trigger 20 is depressed that drives cleaning fluid out the nozzle 23. Releasing the trigger 20 causes liquid to be sucked from the container 12 into the pump 22. Conventional check valves (not shown) prevent rearward flow of the fluid back to the container once it has reached the pump.

As will be appreciated from the seam 60 shown in FIG. 5, the upper portion of the sprayer can be separately formed from the support head. The parts can be snap fit together.

Figure 7:
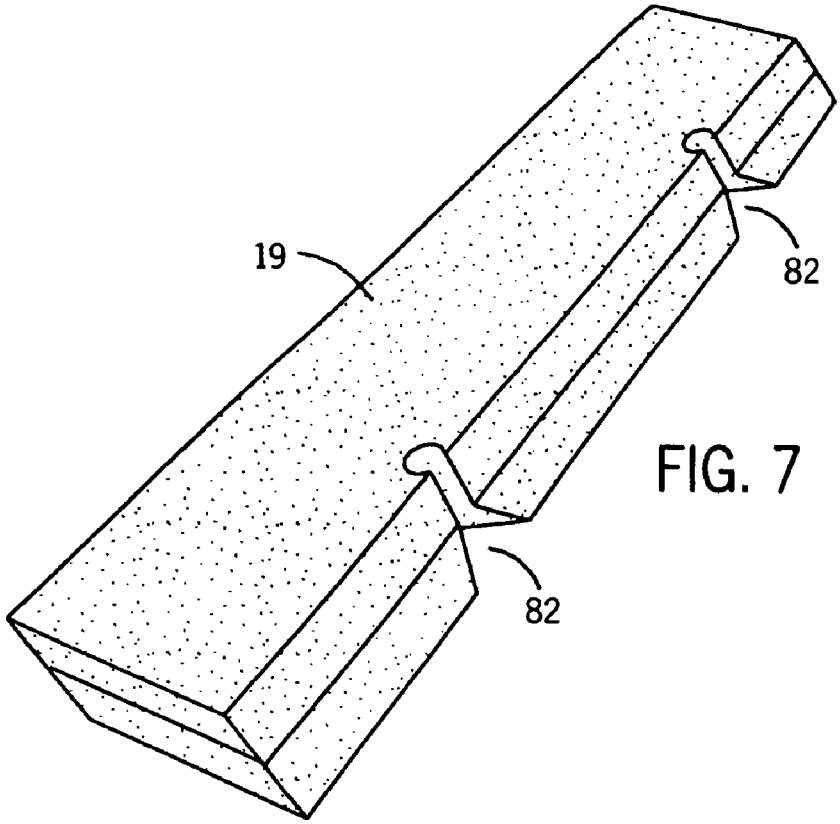
FIG. 7 is a highly enlarged perspective view of that absorbent pad.

Turning now more specifically to FIGS. 5-7, the support head has two parallel channels 65 and 66 designed to receive edges of scrubber 16. The scrubber 16 is bent over into a U shape and then forced into the channels, made of silicone rubber, and has a series of holes 68. The material selection and the holes provide an abrasive character, and the overall assembly permits replacement of the scrubber if it should become worn.

The particular material that the scrubber is made of is not critical. The scrubber could instead be a brush or sponge, or even could be a roughened integral plastic surface portion of the support head.

As best seen in FIG. 6 the opposed side of the support head is in the form of a mouth 70 having flexible opposed lips 71 and 72. The upper lip 71 has positioned on its lower surface a squeegee blade 17, which is preferably made of a conventional rubber. However, the specific squeegee material is not critical. The squeegee may be glued to the lower surface of the upper lip. However, it is more preferred for the squeegee to be staked through the upper lip by having integral barbs 74 that extend up into receiving holes through the upper lip.

Collector 19 is mounted in the mouth 70. As shown in FIG. 7, the collector can be a slab like pad having two rearward alignment recesses 82 that receive corresponding tongues 83 (see FIG. 6) of the mouth. This helps restrict side to side movement of the collector 19. The lips 71 and 72 are preferably made of a highly flexible material that is biased such that the lips bite down on the collector pad to normally restrict its removal absent intended replacement of the pad.

The collector 19 is designed so as to be able to have a high capacity for liquid, as well as the ability to quickly collect fluid before the fluid drools past the collector. Moreover, the pad must have sufficient integrity so that it does not degrade and leave residue. Thus, while tissue paper typically has a very high capacity for absorbance, as well as the ability to very quickly absorb water, it would not be an optimal collector as it would crumble and leave lint and other pieces on the window if dragged against the window.

When using the FIG. 1 device, a window can be cleaned and dried without needing any other tool or element. The device provides its own supply of cleaning fluid, provides a desirable way to scrub using that fluid, provides a way to squeegee the used fluid off the window to dry it, and provides a way to collect the fluid that is being squeegeed off. The collector is designed to avoid saturating too quickly, both by virtue of the high maximum capacity of the collector, as well as the ability of the collector to quickly move fluid from saturated portions of the collector near the front edge to portions that are not yet saturated rearward of that front portion.

Figure 9:
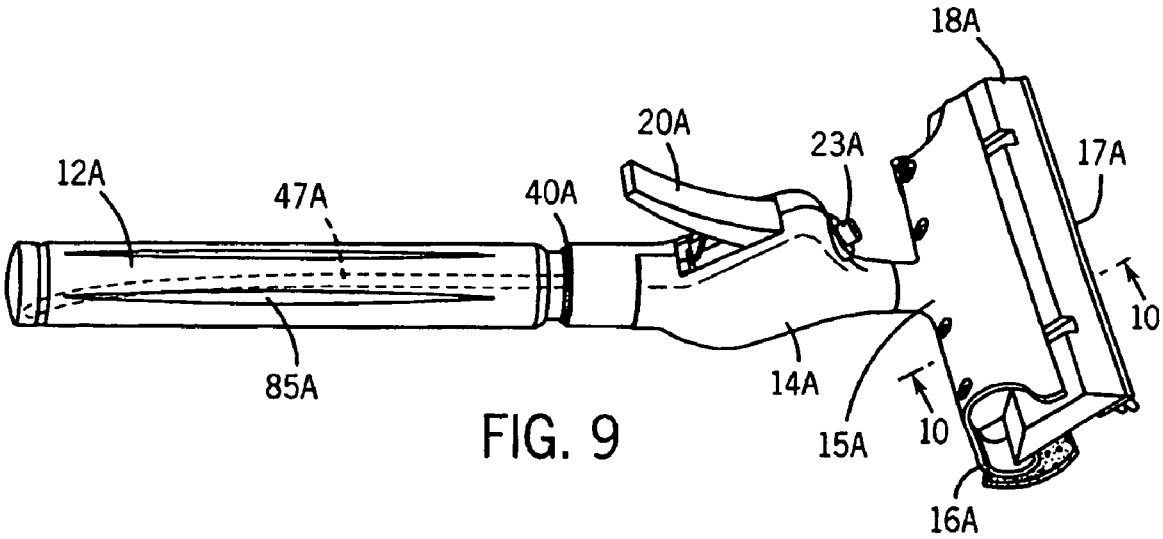
FIG. 9 is a perspective view of a second embodiment.
Figure 10:
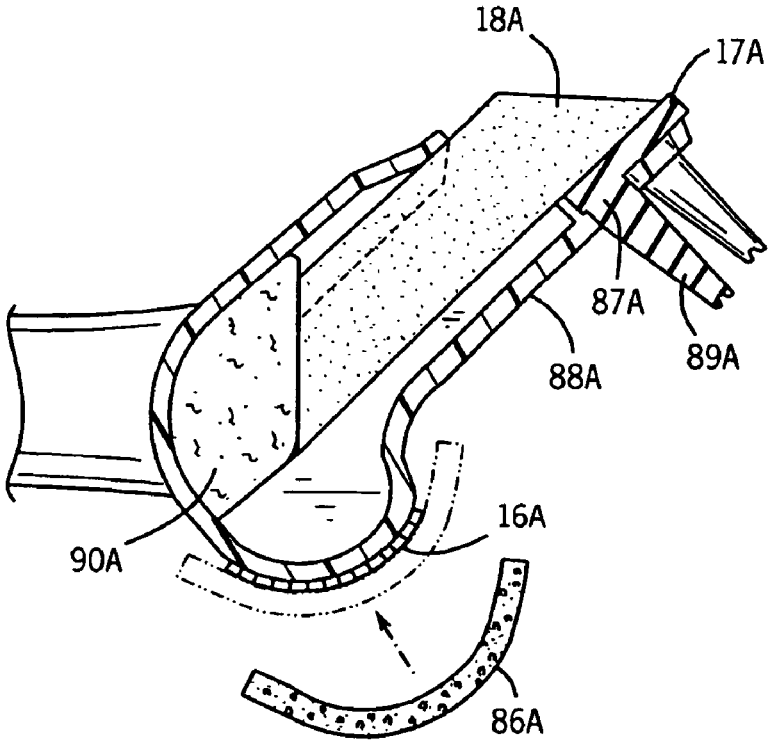
FIG. 10 is an enlarged view, partially in section, of a support head portion of the FIG. 9 embodiment.

A second embodiment of the present invention is shown in FIGS. 9 and 10. In this embodiment there is a replaceable container 12A containing cleaning fluid, linked to a pumping assembly (generally 14A). A support head 15A has a Velcro® type surface 16A, a squeegee blade 17A, and a replaceable absorbent pad 18A.

There are now grip ribs 85A integrally formed down the container exterior walls. Also, the trigger 20A and nozzle 23A are on the side of the support head adjacent the squeegee blade 17A, so as to direct spray to a different side of the device.

Further, the surface 16A is in the form of a layer of Velcro® type hooks or loops. While that inherently has some abrasiveness, the primary scrubbing facility of this embodiment is nubs 89A as will be described below. Surface 16A is instead intended primarily to mount a drying pad/touch-up towel 86A. The towel can be easily replaced by merely ripping a soiled towel off the surface 16A, and then abutting a clean towel against that surface. Of course, the towel itself may have a scrubbing characteristic, but that is not the primary focus of this structure.

In this embodiment the squeegee not only has extensions 87A which mount the squeegee to the mouth 88A, the extensions continue into flexible plastic "nubs" 89A which form rows of additional scrubber members.

Yet another difference is that the collector/absorbent pad 18A is formed so that a replaceable superabsorbent 90A can be mounted behind it. The superabsorbent can be any of the known superabsorbents which absorb more than their starting dry weight. Examples include synthetics commonly used in diapers.

When a superabsorbent is present, the pad 18A functions more as a wick. Thus, the pad 18A becomes a more permanent part of the design, with the superabsorbent being the primary replaceable element of the collector system.

While preferred embodiments of the present invention have been described and otherwise disclosed herein, alternative embodiments are also intended to be within the scope of the claims. For example, the collector need not be an absorbent material (e.g. may be a collector cavity), the sprayer need not be a trigger sprayer (e.g. may be a push pump sprayer), and the scrubber need not be a replaceable or separately formed part. Thus, the invention is not to be judged solely by the preferred embodiments. Rather, the claims should be looked to in order to judge the full scope of the invention.

INDUSTRIAL APPLICABILITY

The present invention provides a cleaning implement for windows or the like which performs multiple functions, and replacement pads and replacement containers for use therewith.

We claim:

1. A cleaning implement, comprising:

a support head mounting a squeegee blade;

a collector removably mounted to the support head adjacent the squeegee blade;

a sprayer linked to the support head;

a container mountable to the cleaning implement so as to place an internal cavity of the container in communication with the sprayer, the container being suitable to contain a liquid in the internal cavity; and a scrubber also mounted to the support head, wherein the scrubber is an apertured bendable pad;

wherein the support head has an open mouth, and the collector is removably mounted directly under and adjacent the squeegee blade; and wherein the cleaning implement is configured such that if the squeegee blade is dragged down a wetted surface being cleaned by the cleaning implement liquid on the surface can be dragged off of the surface against the collector by such downward movement of the squeegee blade.

2. A cleaning implement, comprising:

a support head mounting a squeegee blade;

a collector removably mounted to the support head adjacent the squeegee blade;

a sprayer linked to the support head;

a container mountable to the cleaning implement so as to place an internal cavity of the container in communication with the sprayer, the container being suitable to contain a liquid in the internal cavity; and a drying pad also mounted to the support head;

wherein the support head has an open mouth, and the collector is removably mounted directly under and adjacent the squeegee blade; and wherein the cleaning implement is configured such that if the squeegee blade is dragged down a wetted surface being cleaned by the cleaning implement liquid on the surface can be dragged off of the surface against the collector by such downward movement of the squeegee blade.

3. The cleaning implement of claim 2, wherein the drying pad is a touch-up pad made of microfiber cloth.

4. A cleaning implement, comprising:

a support head mounting a squeegee blade;

a collector removably mounted to the support head adjacent the squeegee blade;

a sprayer linked to the support head; and a container mountable to the cleaning implement so as to place an internal cavity of the container in communication with the sprayer, the container being suitable to contain a liquid in the internal cavity;

wherein the support head has an open mouth, and the collector is removably mounted directly under and adjacent the squeegee blade;

wherein the cleaning implement is configured such that if the squeegee blade is dragged down a wetted surface being cleaned by the cleaning implement liquid on the surface can be dragged off of the surface against the collector by such downward movement of the squeegee blade; and wherein the squeegee blade is mounted to an upper lip of the mouth, and the collector is removably mounted in the mouth.

5. The cleaning implement of claim 4, wherein the mouth flexibly bites against the collector when the collector is mounted in the mouth, and a connection between the collector and a rear portion of the mouth helps align the collector in the mouth.

6. The cleaning implement of claim 1, wherein the collector is made of an absorbent material.

7. The cleaning implement of claim 6, further comprising a superabsorbent mounted adjacent the absorbent collector.

8. The cleaning implement of claim 1, wherein the container is removably linked to a lower end of the sprayer.

9. The cleaning implement of claim 1, wherein the container has a duck bill valve extending through an upper opening of the container.

10. The cleaning implement of claim 1, wherein the collector can absorb and retain at least 50 gm. of water.

11. The cleaning implement of claim 1, wherein the container is supported by an extension pole at an end of the container opposite the sprayer.

12. The cleaning implement of claim 1, wherein the sprayer is a trigger operated sprayer.

* * * * *